US006059181A

United States Patent [19]

Marbry et al.

[11] Patent Number: 6,059,181

[45] Date of Patent: May 9, 2000

[54] PACKAGING SYSTEM FOR NON-RIGID MATERIALS

[75] Inventors: David Marbry, Wauwatosa; Debora J. Rode, Oak Creek, both of Wis.

[73] Assignee: Henkel Corporation, Gulph Mills, Pa.

[21] Appl. No.: 09/299,860

[22] Filed: Apr. 26, 1999

Related U.S. Application Data

[60] Provisional application No. 60/088,539, Jun. 4, 1998.

[51] Int. Cl.[7] ..... B65D 5/56

[52] U.S. Cl. ..... 229/120.36; 53/263; 53/449; 53/466; 53/539; 206/499; 229/87.08; 229/120.36; 229/164.2; 493/92; 493/100; 493/907; 493/912

[58] Field of Search ..... 229/120.36, 120.37, 229/120.38, 164.2, 87.08; 206/499; 217/30–32; 426/108, 119, 130; 53/170, 174, 263, 246, 449, 461, 466, 539; 493/90–92, 100, 907, 912

[56] References Cited

U.S. PATENT DOCUMENTS

| | | | |
|---|---|---|---|
| 2,768,906 | 10/1956 | James | 229/87.08 |
| 2,870,023 | 1/1959 | Vogt | 229/87.08 |
| 3,345,795 | 10/1967 | Anderson | 493/912 |
| 3,516,596 | 6/1970 | Madden et al. | 206/499 |
| 4,038,428 | 7/1977 | Davis, Jr. | 53/449 |
| 4,724,955 | 2/1988 | Martin et al. | 206/499 |
| 5,467,894 | 11/1995 | Altonen et al. | 206/499 |

*Primary Examiner*—Gary E. Elkins

*Attorney, Agent, or Firm*—Ernest G. Szoke; Wayne C. Jaeschke; Stephen D. Harper

[57] ABSTRACT

A packaging system for non-rigid materials includes various embodiments. In one embodiment the blocks of material are separated from each other by a partially wrapped liner with a partition extending between the blocks. In another embodiment pairs of blocks are partially wrapped with a liner and separated from each other by a distance which permits additional blocks to be inserted in an alternating manner in the spacing in between the blocks. In a third embodiment the cells are created by a support which is of generally inverted T-shape with each block being placed in an individual cell.

24 Claims, 3 Drawing Sheets

PACKAGING SYSTEM FOR NON-RIGID MATERIALS

CROSS REFERENCE TO RELATED APPLICATION

This application is based on provisional application Ser. No. 60/088,539, filed Jun. 4, 1998.

BACKGROUND OF THE INVENTION

Various non-rigid materials must be stored and transported. Where such materials are not self-shape retaining, particularly over a period of time, the materials are frequently stored in a single mass which must then be separated into intended use size.

It would be desirable if a packaging system could be provided wherein such non-rigid material could be stored in individual sizes and shapes without requiring separation from a bulk mass.

SUMMARY OF THE INVENTION

An object of this invention is to provide a packaging system for non-rigid materials.

A further object of this invention is to provide such a packaging system wherein the non-rigid materials could be stored in block form of individual use size.

In accordance with one practice of this invention the material is placed on a flexible release liner in blocks of individual size form. The liner is then wrapped at least partially around adjacent blocks of material so that the blocks are separated from each other. In one embodiment of the invention the adjacent blocks are separated not only by the liner material, but also by a partition which is inserted into the close spacing between the blocks. In an alternative embodiment of the invention two adjacent blocks are spaced from each other by a distance corresponding to the size of one of the blocks so that a similar block partially wrapped with a liner in the same manner could be inserted into the spacing.

In a further practice of the invention, the blocks are inserted into cells formed by rigid partition members.

The invention also involves methods of packaging such materials.

THE DRAWINGS

DETAILED DESCRIPTION

The present invention is directed to the provision of a packaging system for separating non-rigid materials into discrete sizes for later use with thereby avoiding the need to remove the materials from a bulk mass. Such materials may initially be rigid, but then lose their rigidity over time. Such materials may also be capable of being extruded into a particular size and shape, but have a viscosity whereby the materials tend to lose their shape. An example of such materials is sealants which are conventionally supplied in 20 pound blocks each of which is in a polyethylene bag. Such material is soft and will not hold its shape unless some techniques are provided to prevent the material from flowing into a single mass. For single use it would be desired to supply the sealant material in a block of, for example, one inch by one inch by four inches rather than supplying the material in bulk form. While the invention will be particularly described with respect to sealants such as Thumbgrade sealants used in the automotive industry, the invention may be used with other types of materials, particularly with materials which might be formed as by extrusion into a predetermined size and shape but which would lose its shape because of the inability to be self-shape retaining.

In accordance with this invention the material is initially supplied in a size and shape intended for a specific limited number of uses, preferably a single use, although sizes and shapes for double, triple, etc. uses could also be provided in accordance with the broad practice of this invention. Such material would preferably be provided in block form wherein a plurality of such blocks are placed in a common carton or package. In accordance with this invention, it is necessary, however, to separate the blocks from each other by some arrangement which maintains the blocks in their original desired size and shape. Such arrangement could be through the use of rigid partitions or could be advantageously through the use of alternate positioning of other blocks of like material. In accordance with the invention the blocks are effectively isolated from each other to maintain the dimensional stability for shipping thereby avoiding the problem that the weight and softness of the material allow the material to flow and mass together. As used herein the term "non-rigid material" is thus intended to include solid materials which, however, are not self-shape retaining, particularly over time. It is to be understood that such materials are intended to include materials which are initially self-shape retaining, but then lose their ability to retain their shape either over time or because of the weight and softness of the material.

Figure 1:
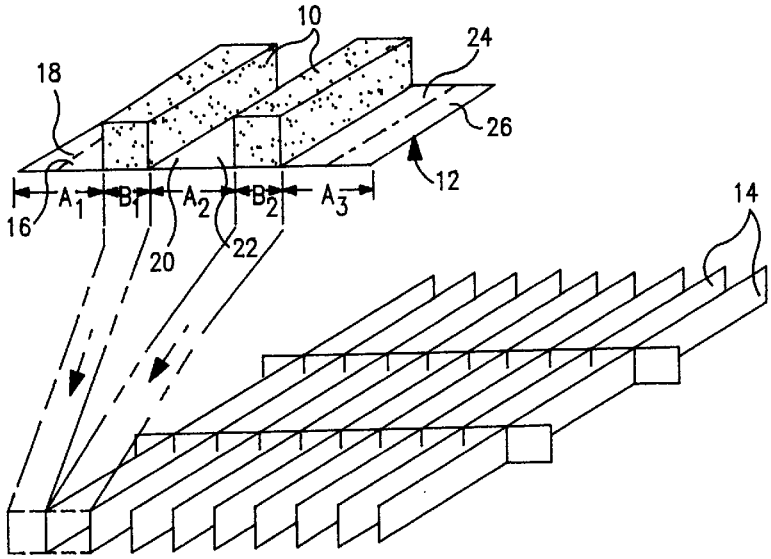
FIG. 1 is a perspective view showing blocks of material placed on a liner in an initial stage of forming the packaging system is one practice of this invention.

FIGS. 1–4 illustrate one practice of the invention for providing a packaging system for such non-rigid materials. As shown in FIG. 1 a pair of blocks 10 of the material is extruded onto a liner 12. The placement of the material is such that the liner is divided into five areas or sections. The areas B represent the portions of the liner 12 on which the blocks 10 are placed. The areas A are of equal distance and represent the portions of the liner 12 along the sides of the blocks. It is intended to place sets of such blocks 10,10 into a package which is separated into cells by partitions 14. As also shown in FIG. 1 such partitions could be of any suitable material including materials conventionally used in the packaging of products such as interlocking chip board, polycoated similar to that used for separating BALL® jars. The liner 12 is made of any suitable flexible material in sheet form such as polyethylene film which would function as a release liner in the sense that the material does not adhere to the liner. The dimension B corresponds to the spacing between adjacent partitions 14 in a cell. The length of block 10 and liner 12 corresponds to the longitudinal dimension of partition 14 in a cell.

The above relative dimensions for the areas or sections of liner 12 apply to a block 10 which has a square cross-section. It is to be understood, however, that the invention may be practiced with blocks having other cross-sectional shapes such as a rectangle where there would be flat sides of one block disposed generally against and in line with the flat sides of the other block, except as separated by the liner and partition. The invention may also be practiced with shapes other than squares or rectangles, including arcuate type shapes, although such shapes are not as preferred because such shapes do not lend themselves to space economy and require more difficult conforming shapes for the liners and partitions. Where, for example, arcuate shapes are used the liners would extend around each block over a significant portion of the periphery of the block so that, in effect, about ¾ of the block is covered thereby generally comprising a three sided covering of the block. The partitions would have to have a shape corresponding to the shape of the block. Thus a partition for an arcuate block would have an arcuate wall for one block connected to an arcuate wall for its adjacent block. As noted, however, these non-square or non-rectangular shapes are not as preferred.

Since the invention could be practiced with shapes other than squares, the broad relationship in the relative dimensions of the different areas of liner 12 will be described with respect to FIG. 1. The liner is divided into a pair of end sections $A_1$ and $A_3$ with a central section $A_2$ located between two intermediate sections $B_1$ and $B_2$. The dimension of each intermediate section $B_1$ and $B_2$ would be generally equal to the width of the block. The dimension of central section $A_2$ would be generally equal to two times the height of each block with there being enough extra dimension to accommodate the later inserted intermediate partition. The dimension of the end sections $A_1$ and $A_3$ would generally be equal to at least the height plus the width of each block so that there is a sufficient amount of liner section to extend upwardly along the side of the block and then be folded over to cover the top of the block.

The partition structure as illustrated in FIG. 1 includes the plurality of spaced parallel longitudinal members 14 interconnected by spaced parallel transverse members 15 to form an interlocked assembly or a corrugation assembly. The members 14 and 15 are made of a rigid material to function as stiffeners for stabilizing or maintaining the shape of the blocks. Thus, the longitudinal members 14 function as partitions between the side walls of adjacent blocks, while transverse members 15 function as end walls for the cells which contain the blocks 10.

Figure 2:
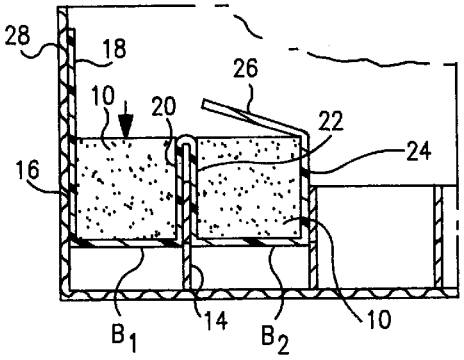
FIG. 2 is a fragmental cross-sectional view showing partially wrapped blocks of material being placed into a package in a later stage of forming the packaging system of FIG. 1.
Figure 3:
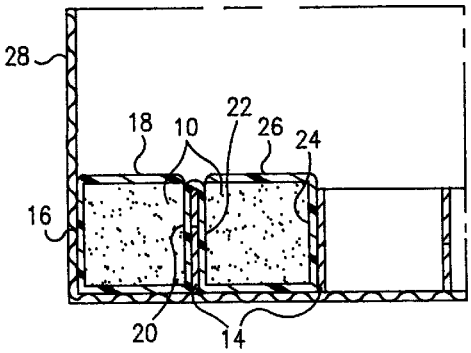
FIG. 3 is a view similar to FIG. 2 showing the blocks of material in the fully wrapped condition in a package in accordance with the practice of this invention of FIGS. 1–2.

When the liner 12 holding the pair of blocks 10 is placed into the cells of the partitioned arrangement, the partition 14 forces the liner 12 upwardly in areas A. This results in a partial wrapping of the set of blocks. For example, with a block 10 dimensioned to be one inch high, one inch wide and four inches long, dimension B would be one inch, while dimensions A would be two inches. By placing the blocks 10,10 and liner 12 into the spacing between the partitions 14 the partitions force the portion 16 of end segment $A_1$ to move upwardly along side of block 10 as shown in FIG. 2 with the remaining half 18 of segment $A_1$ located upwardly beyond block 10 so that it could then be folded over the top of block 10 and act as a cover for the top. Segment $B_1$ of sheet 12 is located under block 10 while segment $A_2$ is divided into halves 20,22. Halves 20,22 become separated from each other by the intervening partition 14 as shown in FIGS. 2–3. Portion 20 of segment $A_2$ covers the side of the first block while the remaining portion 22 covers the adjacent side of the second block 10. The bottom of the second block rests on portion $B_2$ of sheet 12. The remaining portion of $A_3$ sheet 12 is divided into halves 24,26. Half 24 covers the outer side wall of the second block, while the remaining half 26 folds over to cover the top of the second block. The edges of portions 18 and 26 may optionally be extended beyond their respective block, forming a tab 19 which may be grasped for easy removal and subsequent use. A skip slit may be cut into the top ridge between portions 20 and 22 shown in FIG. 2. Where there is a covering liner above the blocks, a slit may be formed in the liner, allowing separation by tearing apart. One or both portions 18,26 may be made slightly longer to overlap the other portion.

A second set of material blocks 10,10 and sheet 12 would then be placed in the next pair of cells formed by the next pair of partitions 14. This practice could be repeated by having the partitions disposed within a container, such as a corrugated cardboard box 28, until the entire bottom of box 28 is filled with the sets of wrapped material blocks. Further layers could then be placed atop each other in the same manner as schematically shown in FIG. 4.

Figure 4:
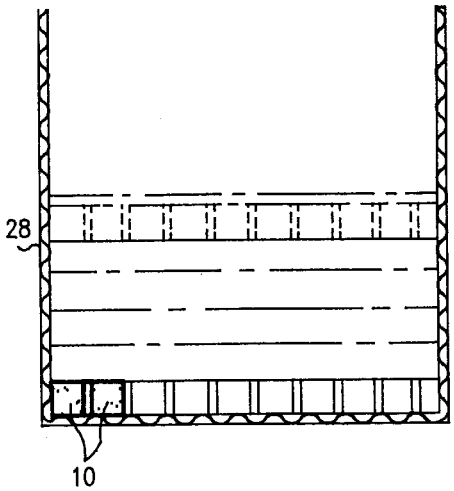
FIG. 4 is a cross-sectional view showing a plurality of sets of blocks in a common package in accordance with this invention in the practice of FIGS. 1–3.

As illustrated, for example, in FIGS. 2 and 4 the box or carton 28 includes a pair of opposite side walls 27 interconnected by end walls 29 with the side walls and end walls extending upwardly from bottom wall 31. These various walls are made of sufficiently rigid material to support and stabilize the blocks. For example, the side walls 27,27 provide support for the outer surfaces of the blocks in the end rows of cells while the partitions support the blocks in the intermediate rows. The end walls 29 form end walls of the cells which are adjacent to those walls. The bottom wall 31 supports the bottom of each cell.

By the arrangement of FIGS. 1–4 the material blocks are thus wrapped with liner material so that layers of blocks could be placed atop each other and yet the individual blocks are maintained separate for each other. The blocks maintain their shape by the provision of partitions 14 which have sufficient rigidity to remain in a vertical condition. The ends of the blocks are supported by the transverse partitions 15 and by the rigid walls 27,29,31 of carton 28.

FIG. 2 represents a preferred embodiment where no chip board dividers are used. In the illustrated example the section is 3 inches long to allow a folded tab between the blocks to allow pulling out the blocks. End to end contact is prevented with L-shaped dividers having the horizontal leg of the L-shaped release liner on top of a lower row of blocks with the vertical leg preventing end to end contact of rows of upper blocks on each side of the liner. Alternatively, a portion at the end of each block may removed after extruding and cutting to length to allow the ends of the sheet to be folded up and thereby act as a separator to prevent end to end contact between longitudinally aligned blocks.

Figure 5:
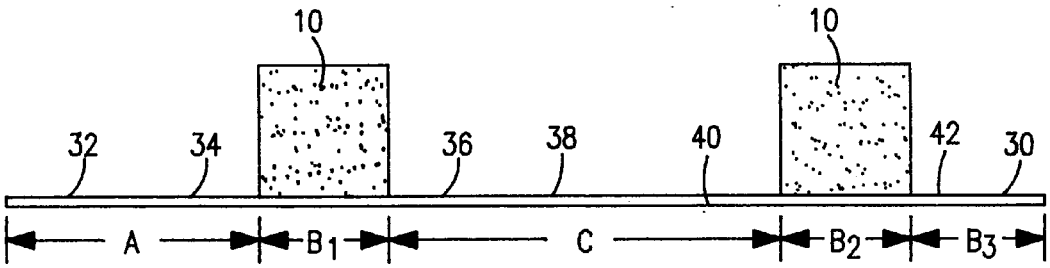
FIG. 5 is a side elevational view showing blocks of material placed on a liner in accordance with an alternative packaging system in accordance with this invention.
Figure 6:
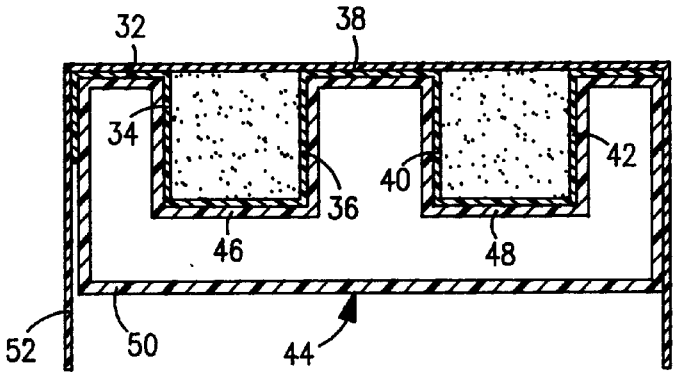
FIG. 6 is a side elevational view showing a later stage of forming a package in accordance with the embodiment of FIG. 5.
Figure 7:
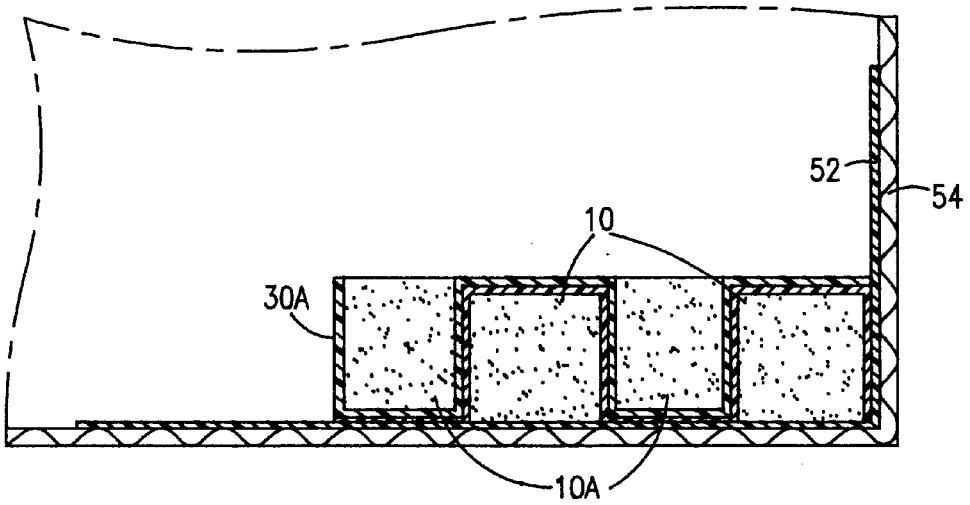
FIG. 7 is a side elevational view showing plural sets of blocks of material in accordance with the practice of this invention shown in FIGS. 5–6.

FIGS. 5–7 illustrate an alternative embodiment of this invention. As shown therein, blocks 10 are placed on a sheet 30 divided into sections indicated by the letters A, B and C. Sections $B_1$, $B_2$ and $B_3$ could each be one inch wide in one example of the invention. Section C could be three inches wide and could be separated into one inch thirds 36,38,40. Section $B_3$ is indicated by the reference numeral 42 and is adjacent section $B_2$.

With respect to FIG. 5 the dimensional relationships between the end sections A and $B_3$ and the intermediate sections $B_1$ and $B_2$ and central section C of sheet 30 are the following. The dimension of intermediate section $B_1$ and $B_2$ would be generally equal to the width of blocks 10,10. The dimension of end section $B_3$ is generally equal to the height of block 10. The dimension of end section A is generally equal to the height plus the width of block 10. The dimension of central section C is generally equal to two times the height of block 10 plus the width of block 10.

As shown in FIG. 6 a fixture 44 is provided which includes a pair of three walled pockets 46,48 which are part of the rigid frame 50. Each pocket has a bottom wall 47 and peripheral side walls 49, but is open at the top. The pair of blocks 10,10 and liner 30 are dropped into fixture 44 which, in turn, causes the liner 30 to partially wrap around blocks 10,10, namely along three sides of each block. For example, portions 34 and 36 wrap around the opposed side walls of one block, while portions 40 and 42 wrap around the walls of the other block. Intermediate portion or connecting wall 38 is disposed between and generally in line with the tops of both blocks by being on a horizontal section 51 of frame 50, as illustrated in FIG. 6. End portion 32 is outwardly of and in-line with one of the blocks by being on a further horizontal section 53 of frame 50. A further sheet or outer cover liner 52 (which may be made of a material similar to liners 12,30) is placed over the fixture. The assembly of the cover liner 52 and blocks 10,10 with liner 30 is then inverted and placed into carton 54 as shown in FIG. 7. The end walls 29 of rigid carton 54 support the end walls of blocks 10,10. As with the embodiment of FIGS. 1–4 the side walls 27 and bottom wall 31 of carton 54 also function to support and stabilize the blocks that come into contact with those walls.

A second pair of blocks 10A, 10A with its liner 30A similar to the first set of blocks 10, 10 and its liner 30 is placed in fixture 44 to partially wrap the liner 30A around the blocks 10A, 10A in the same manner as liner 30 being wrapped around blocks 10,10. The second set of blocks is then lowered into place without being inverted from the fixture 44 into the spaces created by the spaced blocks 10,10 so as to provide alternate sets of blocks 10A,10,10A,10 (as shown in FIG. 7). Such placement of blocks into carton 54 could be done in any suitable manner such as by use of a fork shaped lifting fixture. When the inverted blocks are placed in carton 54 cover liner 52 remains within carton 54 as an inside liner for the carton. The procedure can be repeated until a sufficient amount of blocks are placed in carton 54.

With the arrangement of FIGS. 5–7 rows of blocks and their cells would be such that the cells, which are defined by the generally U-shaped liners, would be placed directly on top of and in contact with the blocks from the generally inverted U-shaped liners and vice-versa. The stacking would be repeated until carton 54 is sufficiently full. Because of the rigid support provided by the walls of carton 54 and because of the close packing of the blocks, each block itself functions as a stiffening partition for its adjacent blocks. Thus, the blocks in the cells from the U-shaped liners act as stiffening partitions for the blocks in the cells from the inverted U-shaped liners and vice-versa.

Figure 8:
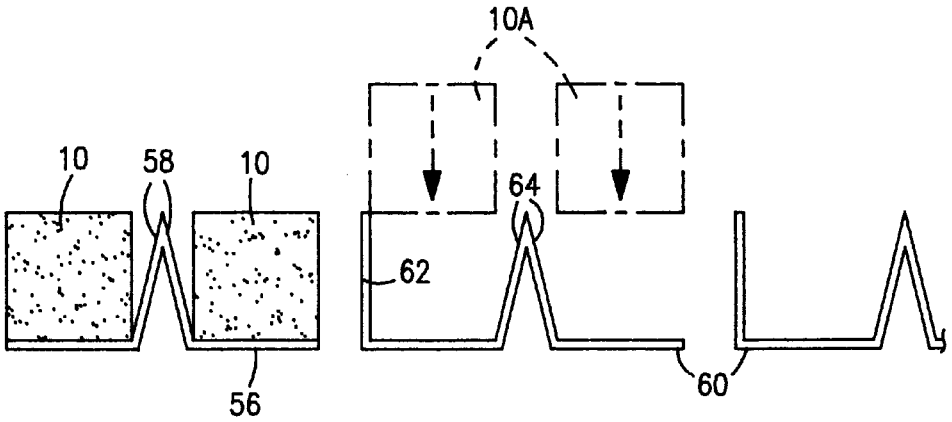
FIG. 8 is a side view in elevation showing the placement of material blocks in accordance with a further embodiment of this invention.

FIG. 8 illustrates yet another embodiment of the invention which utilizes a plurality of rigid members 56,60 such as cardboard partitions. The members 56 are of inverted T-shape and include as the central portion of the T-shape, upstanding portions 58 which may form a general inverted V-shape as illustrated. The partition 56 includes a generally horizontal wall 57 extending outwardly from each upstanding wall portion 58. An adjacent partition 60 is also of generally inverted T-shape but has an upstanding leg 62 in addition to the pair of upstanding portions 64. Upstanding wall or leg 62 extends upwardly from one horizontal wall 61, while the other horizontal wall 61 has no upstanding wall. Such arrangement of partitions 56,60 would extend across a suitably dimensioned carton. The first support member 56 need not have an end leg, such as leg 62, because the carton wall would function to provide support. Similarly, the opposite carton wall could provide side support for the last block. If desired, however, all support members could have a vertical leg at one or both ends thereof to avoid having different types of support members.

In the embodiment of FIG. 8 the blocks 10 are placed upon the support member 56 in the two cells created on each side of central partition 58. A second pair of blocks 10A,10A which may also be extrusions is then placed on support 60 in the two cells created on each side of central partition 64. The leg 62 separates adjacent blocks 10,10A. When the support carrying blocks are placed in the carton, the spacing between the vertical partitions 58 and 64 would close so that instead of an inverted V, there is a sufficiently tight fit.

The advantage of the packaging system of FIG. 8 is that it is easier to drop the extrusions or blocks into the cells and the separation of the blocks is accomplished without the necessity of liners.

What is claimed is:

1. A packaging system for non-rigid materials comprising a carton having opposite side walls, a plurality of rows of cells in said carton, said rows of cells including an end row juxtaposed each of side walls of said carton, said rows of cells further including intermediate rows between said ends rows, each of said cells of said intermediate rows being defined by a three sided liner having two parallel sides and a connecting side, a block of said non-rigid material in each of said cells, a stiffening partition adjacent each of said blocks, and said stiffening partition being located against and between one of said liner parallel sides at one of said blocks and a further one of said liner parallel sides of an adjacent one of said blocks for facilitating said non-rigid material maintaining its block form.

2. The system of claim 1 wherein each of said liners is a flexible sheet.

3. The system of claim 2 wherein one of said liners is a single sheet for creating two of said cells for two of said blocks.

4. The system of claim 3 wherein said single sheet is folded to form a pair of U-shapes having remote outer walls and adjacent inner walls.

5. The system of claim 4 wherein said outer walls of said sheet extends beyond said two of said blocks in said cells and are folded over said two of said blocks, and each of said two of said blocks being thereby covered on four sides by said sheet.

6. The system of claim 5 wherein said single sheet of each of said cells of said intermediate rows is divided into five sections comprising two end sections and an intermediate section adjacent each end section, and a central section between said intermediate sections, said intermediate sections having a dimension generally equal to the width of said respective block within its said cell, said central section having a dimension generally equal to two times the height of said respective block within its said cell and said end sections having a dimension generally equal to the width plus the height of said respective block within its said cell.

7. The system of claim 6 wherein a plurality of said liners are mounted around corresponding pairs of said blocks in said carton.

8. The system of claim 7 wherein said partitions are part of an interlocked assembly in said carton, said interlocked assembly comprising a plurality of longitudinal members interlocked with a plurality of transverse members, said longitudinal members, and said transverse members being made of a stiff material, said longitudinal members comprising said partitions and said transverse members comprising end walls for said blocks.

9. The system of claim 8 wherein a plurality of rows of said blocks and said liners are stacked atop each other, said carton having opposite end walls between said side walls, and said side walls and said end walls of said carton comprising stiffening members for said blocks which are adjacent to said end walls and said side walls.

10. A packaging system for non-rigid materials comprising a carton having opposite side walls, a plurality of rows of cells in said carton, said rows of cells including an end row Juxtaposed each of said side walls of said carton, said rows of cells further including intermediate rows between said ends rows, each of said cells of said intermediate rows being defined by a three sided liner having two parallel sides and a connecting side, a block of said non-rigid material in each of said cells, a stiffening partition adjacent each of said blocks, said three-sided liner being a rigid member in the share of an inverted T having a central vertical portion and outwardly extending horizontal portions, said central vertical portion being formed by a pair of generally vertical walls, said vertical walls comprising said partition between adjacent blocks, said inverted T further including a generally vertical upstanding end wall extending upwardly from one of said horizontal portions generally parallel to said central portions, and wherein there are a plurality of said liners with said upstanding generally vertical wall of said one of said liners contacting and supporting the block of an adjacent liner.

11. The system of claim 10 wherein said end rows of said cells include an inverted T-shaped liner without an end wall, and said side walls of said carton contacting and supporting said blocks in said end rows.

12. The system of claim 11 wherein rows of said cells and blocks are stacked atop each other in said carton.

13. A method of packaging non-rigid materials comprising arranging blocks of the materials in cells in a plurality of side by side rows which form end rows and intermediate rows, the intermediate rows of cells being defined by liner structure wrapping around three sides of each block, providing a stiffening partition adjacent each of the blocks in the intermediate rows, placing the rows of blocks and cells in a carton having opposite side walls and intermediate end walls extending upwardly from a bottom wall, the liner structure comprising a plurality of flexible sheets, creating pairs of cells in adjacent rows by folding a liner sheet into a pair of generally U-shaped forms having opposite remote end walls and adjacent inner walls, and inserting the partition between the adjacent inner walls.

14. The method of claim 13 including folding end portions of the liner sheet over the tops of the blocks.

15. The method of claim 14 including creating an interlocked assembly from a plurality of stiff longitudinal members interlocked with a plurality of stiff transverse members, and mounting each cell and its liner between pairs of longitudinal members with the longitudinal members comprising the partitions and with the transverse members comprising the end walls for the cells.

16. The method of claim 15 including stacking a plurality of the rows of blocks and cells atop each other in the carton.

17. The method of claim 13 wherein the blocks are extruded directly on the liner structure.

18. A method of packaging non-rigid materials comprising arranging blocks of the materials in cells in a plurality of side by side rows which form end rows and intermediate rows, the intermediate rows of cells being defined by liner structure wrapping around three sides of each block, providing a stiffening partition adjacent each of the blocks in the intermediate rows, placing the rows of blocks and cells in a carton having opposite side walls and intermediate end walls extending upwardly from a bottom wall, including forming the cells for alternate rows by a first liner in the form of a first single flexible sheet wrapped in generally U-shaped form around alternate sets of blocks in alternate rows and forming intermediate cells for intermediate rows of blocks by wrapping a second liner in the form of a second flexible liner sheet in generally inverted U-shaped form around the blocks of intermediate rows disposing the blocks in the generally U-shaped sheets between the blocks in the generally inverted U-shaped sheets with each block functioning as the stiffening partition for its adjacent block.

19. The method of claim 18 wherein the liner sheets are formed into their respective shapes by means of a fixture having U-shaped pockets with intermediate connecting walls, and inverting alternate sets of the U-shaped pockets to form the inverted U-shaped liner sheets.

20. A packaging system for non-rigid materials comprising a carton having opposite side walls, a plurality of rows of cells in said carton, said rows of cells including an end row juxtaposed each of said side walls of said carton, said rows of cells further including intermediate rows between said ends rows, each of said cells of said intermediate rows being defined by a three sided liner having two parallel sides and a connecting side, a block of said non-rigid material in each of said cells, a stiffening partition adjacent each of said blocks, said intermediate rows of cells comprises at least two sets of first rows and at least two sets of second rows, at least one of said first rows being between two of said second rows, and said three sided liner for said at least one of said first rows and said three sided liner for said two of said second rows being a single flexible sheet.

21. The system of claim 20 wherein said flexible sheet includes a first end section and a second end section remote from said first end section and a central section and intermediate sections between said end sections and said central sections, said intermediate sections having a dimension generally equal to the width of said blocks, said central section having a dimension generally equal to two times the height of said blocks plus said width of said blocks, and said end sections having a dimension at least equal to said height of said blocks.

22. A packaging system for non-rigid materials comprising a carton having opposite side walls, a plurality of rows of cells in said carton, said rows of cells including an end row juxtaposed each of said side walls of said carton, said rows of cells further including intermediate rows between said ends rows, each of said cells of said intermediate rows being defined by a three sided liner having two parallel sides and a connecting side, a block of said non-rigid material in each of said cells, a stiffening partition adjacent each of said blocks, said intermediate rows of said cells comprising at least two sets of first rows of said blocks and at least two sets of second rows of said blocks, said first rows and said second rows being adjacent each other in an alternating arrangement with at least one first row being between two of said second rows and with at least one second row being between two of said first rows, each of said cells of said intermediate rows being formed by said liner which is a single flexible sheet, said single flexible sheet being bent in alternating fashion to form adjacent alternating U-shapes and inverted U-shapes, said blocks of said first rows being inserted in said U-shapes, said blocks in said second rows being inserted in said inverted U-shapes, said single sheet being thereby wrapped around three sides of each of said blocks, said blocks in said U-shapes comprising said stiffening partitions for said blocks in said inverted U-shapes, and said blocks in said inverted U-shapes comprising said stiffening partitions for said blocks in said U-shapes.

23. The system of claim 22 wherein said carton includes end walls between said side walls and a bottom wall from which said end walls and said side walls extend, an outer liner over said bottom wall and extending upwardly along at least one of said side walls, and said outer liner being wrapped around said rows of said cells.

24. The system of claim 22 including each of a plurality of said first rows mounted directly above and in contact with a respective one of said second rows, and each of a plurality of said second rows being above and in contact with a respective one of said first rows to form stacks of said first and second rows.

* * * * *